United States Patent [19]

Perkins

[11] Patent Number: 4,489,782

[45] Date of Patent: Dec. 25, 1984

[54] VISCOUS OIL PRODUCTION USING ELECTRICAL CURRENT HEATING AND LATERAL DRAIN HOLES

[75] Inventor: Thomas K. Perkins, Dallas, Tex.

[73] Assignee: Atlantic Richfield Company, Los Angeles, Calif.

[21] Appl. No.: 560,697

[22] Filed: Dec. 12, 1983

[51] Int. Cl.[3] ..... E21B 43/24

[52] U.S. Cl. ..... 166/248; 166/65 R

[58] Field of Search ..... 166/248, 60, 65 R, 50, 166/61

[56] References Cited

U.S. PATENT DOCUMENTS

| | | | |
|---|---|---|---|
| 2,801,090 | 7/1957 | Hoyer et al. | 166/60 |
| 3,522,848 | 8/1970 | New | 166/60 |
| 3,862,662 | 1/1975 | Kern | 166/248 |
| 3,874,450 | 4/1975 | Kern | 166/248 |
| 4,144,935 | 3/1979 | Bridges et al. | 166/60 |
| 4,265,307 | 5/1981 | Elkins | 166/60 |
| 4,436,165 | 3/1984 | Emery | 166/50 |
| 4,444,265 | 4/1984 | Schmidt | 166/50 |

*Primary Examiner*—Stephen J. Novosad
*Assistant Examiner*—Bruce M. Kisliuk
*Attorney, Agent, or Firm*—M. David Folzenlogen

[57] ABSTRACT

Improved electrical power utilization and increased oil production per producing well are achieved by specially completing a production well, applying electrical current through the production well to a subsurface formation, and producing oil from said formation. The production well extends essentially vertically from the surface and has one or more drain holes, preferably cased with tubular steel, extending laterally from the longitudinal vertical axis of the wellbore and into and traversing a part of the oil bearing formation. The length of the producing well traversing and being in fluid communication with the formation being substantially greater than the thickness of the oil bearing formation.

26 Claims, 2 Drawing Figures

VISCOUS OIL PRODUCTION USING ELECTRICAL CURRENT HEATING AND LATERAL DRAIN HOLES

BACKGROUND OF THE INVENTION

This invention pertains to an improved apparatus and method of producing viscous oil from a subsurface formation. More particularly, electrical formation heating and one or more slanted or horizontal boreholes extending from the same production well are combined to enhance the amount of oil produced with a given amount of electrical power.

For many years, it has been known that large deposits of relatively shallow, viscous oil are present in subterranean formations. Normally, the viscous oil is produced through a vertical production well. The well productivity is nearly inversely proportional to the viscosity of the oil. It has been proposed, for example, in U.S. Pat. Nos. 3,642,066; 3,874,450; 3,848,671; 3,948,319; 3,958,636; 4,010,799 and 4,084,637, to use electrical current to add heat to a subsurface pay zone containing tar sands or viscous oil to render the viscous hydrocarbon more flowable. Electrodes are connected to an electrical power source and are positioned at spaced apart points in contact with the earth. Currents up to 1200 amperes are passed between the electrodes. This heats oil in the formation. Electrical power utilizes energy from various sources. This energy is expended for viscous oil. Therefore, the relative success of electric heating is dependent on the amount of oil produced per unit of electric power applied. The effectiveness of the electrical process is partially limited by the effective radius of the borehole, for example, a radius of 0.5 foot, into which the oil flows from the formation.

In normal oil and gas producing operations, for various reasons, for example intersecting thin strata, it has been proposed to drill a slanted or essentially horizontal well. At an appropriate point in the earth, an essentially vertical borehole is deviated or drilled through an appropriate radius of curvature so as to extend laterally away from the vertical axis of the vertical borehole and extend either in a slanted manner or in an essentially horizontal manner through a portion of the formation.

It is the primary objective of this invention to increase oil production from a subsurface viscous oil bearing formation by combining electrical heating with one or more laterally extending slanted or horizontal boreholes having an effective production radius greater than normal.

SUMMARY OF INVENTION

In accordance with this invention, viscous oil is produced from a subsurface formation through a combined electrode-production well. The well is completed in the formation in a manner such that the effective radius of the well exceeds the effective radius of an essentially vertical well. The increase in effective radius is provided by one or more slanted or horizontal boreholes, hereinafter called drain holes, extending laterally into and across part of the formation. The drain hole or holes and any part of the vertical part of the well in the formation may be cased with tubular steel pipe which pipe or pipes serve both as electrode surfaces and as highly conductive flow passages in the formation flowing into the vertical part of the production well. Preferably the steel pipes will be perforated and will have a cylindrical flow passage with a diameter at least 0.25 times the diameter of the flow passage in the vertical part of the well. If the drain holes are not cased with metal, other forms of electrodes may be placed in the formation through the production well. Thereafter, electric current is passed from the production well through the formation to increase the temperature of oil therein and the heated oil is produced through the drain hole or holes and the same well. The increased effective radius of the well and possibly the increased electrode surface increases the effectiveness of electric power used to increase the temperature of the viscous oil. This increases the amount of oil produced. The total improvement of the combination of electric heating and the drain hole or holes depends on the completion technique and the length, number and spacing of the lateral drain holes, but production increases with the same amount of electrical power are expected to be up to 3 to 5 times and more greater than electric heating itself or drain holes by themselves. In addition, the other advantages of lateral drain holes are combined with electical formation heating.

DESCRIPTION OF PREFERRED EMBODIMENTS

Figure 1:
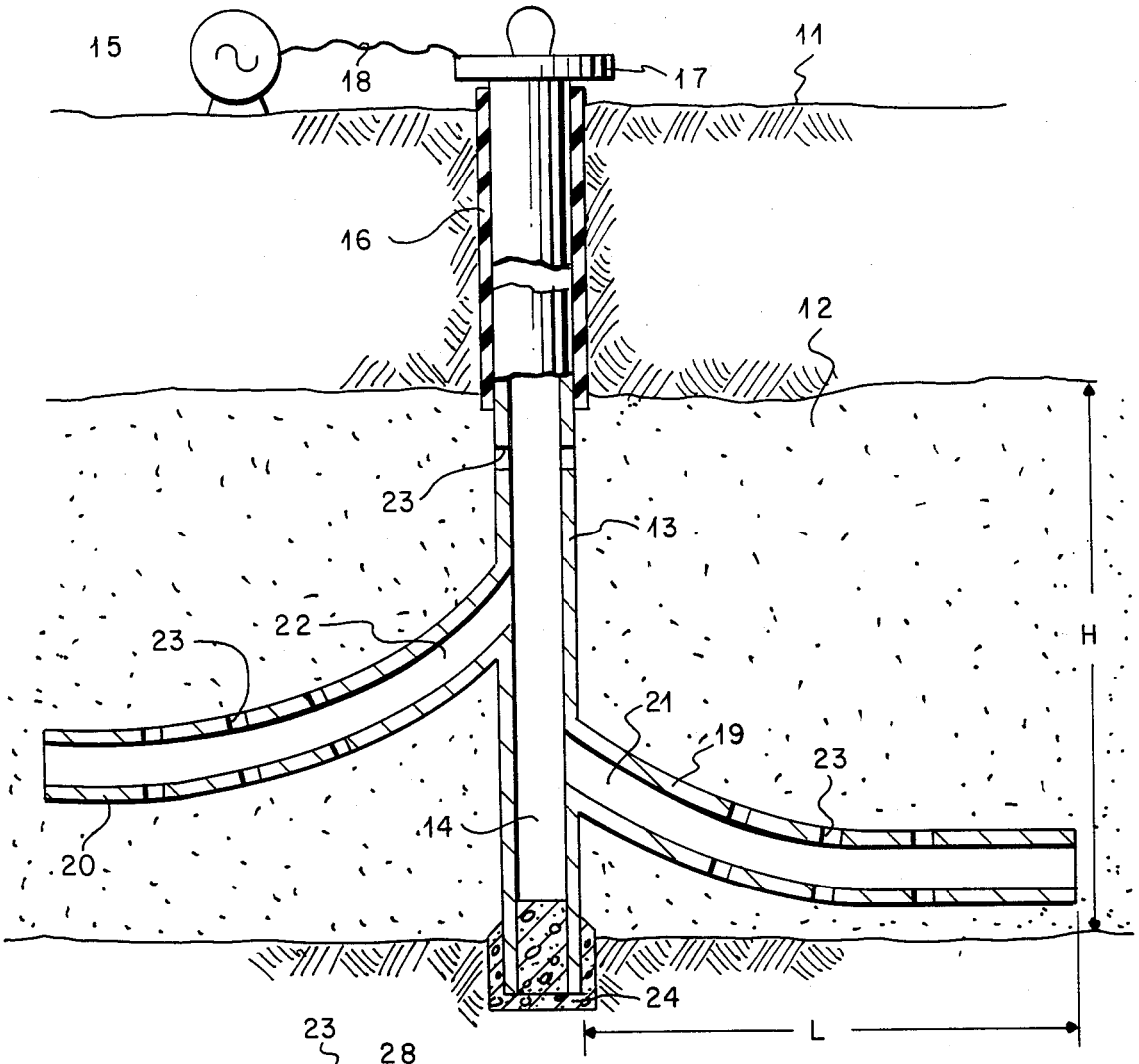
FIG. 1 shows a cross section of a wellbore passing through a subsurface formation containing viscous oil. The wellbore illustrates preferred features for accomplishing the objectives of this invention.
Figure 2:
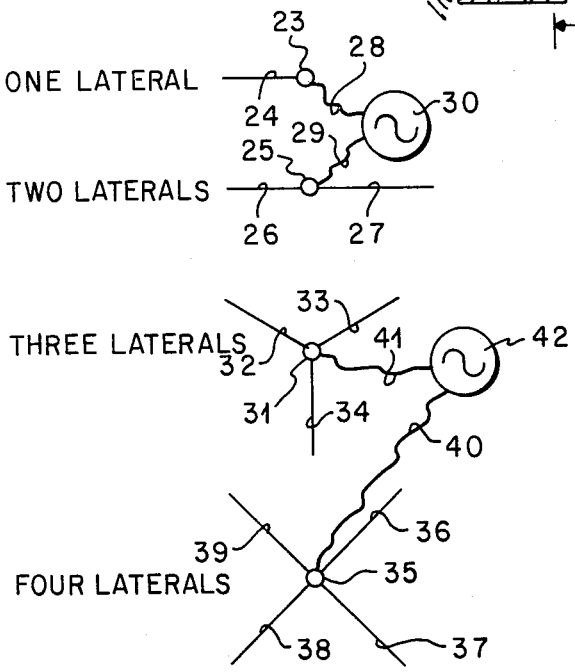
FIG. 2 is a diagrammatic top view illustrating various numbers of lateral drain hole configurations extending laterally from a wellbore.

In FIGS. 1 and 2, there are illustrated well completion techniques for transmitting electrical current power into a subsurface formation to heat viscous oil therein and for producing oil therefrom in a manner that enhances electrical power efficiency by increasing oil production. The improved combination of applying electric power and of producing oil utilizes one or more slanted or horizontal drain holes extending laterally from a vertical portion of a well into and traversing a part of the formation in a manner and of a length such that the effective radius of the production well is significantly greater than the effective radius of an essentially vertical well. The amount and degree of benefit derived depends on the total length of the part of the well located in the formation and on how the drain holes are completed. An optimum completion for two laterally extending drain holes is illustrated in FIG. 1 wherein a wellbore was drilled from surface 11 of the earth in standard fashion with a drilling or workover or recompletion rig (not shown) to extend essentially vertically downward into or through formation 12 which contains viscous heat sensitive oil. Two drain hole wellbores have been drilled laterally from a primary vertical wellbore in a manner such that after passing through a radius of curvature, the drain holes extend laterally away from the primary wellbore out into oil producing formation 12. The drain holes enhance the flow of oil from formation 12 by collecting the oil from a greater effective wellbore radius and conducting it to the primary wellbore. In conventional manner, the oil is pumped, lifted or flowed through the vertical part of the well to the surface of the earth. The parts of the vertical wellbore, if any, in the formation and the drain hole wellbores can be either cased or uncased, or cemented or uncemented, with cement, plastic, metal, fiberglass and the like, provided that the wellbores remain open for production of oil from the formation. For example, some viscous oil bearing formations are unconsolidated and the wellbores must be supported to remain open. If the wellbores are not cased with metal pipe, an electrode or electrodes may be placed in the formation. Although this invention improves oil production without the drain holes being cased with steel pipe, it is to be understood that the degree of improved utilization of electrical power and increased oil production achieved with the combination of this invention is greatly enhanced if the drain holes and the part of the vertical wellbore, if any, extending into formation 12 are cased with steel pipe. Accordingly, the vertical portion of the well is cased with production casing 13 which may be casing, tubing, tubular pipe or any other similar form of tubular goods. Production casing 13 has cylindrical flow passage 14 which provides a flow passage leading to the surface of the earth into which tubing, a pump, a gas lift system or other production equipment may be installed. Production casing 13 is comprised of casing sections. The part of the casing in formation 12 may then be used as a tubular electrode and the upper part is used as an electric conductor for power source 15. In order to reduce overall impedance of the electric transmission system and reduce the magnetic hysteresis losses if alternating current is used, the upper part of the casing may be comprised of a nonmagnetic metal, such as, for example, stainless steel or aluminum. Corrosion and premature loss of power to the overburden above formation 12 or the underburden below the formation may be prevented by any standard technique, for example, electrical insulation 16. This outer insulation may be comprised of cement, coatings, pipe wrapping, extruded plastic, heat shrinkable sleeves, or other similar insulating or nonconductive corrosion protection materials. Some of the insulation may be pre-applied. Production casing 13 is shown connected in typical fashion to casing hanger 17 represented schematically. The casing hanger is electrically connected via conductor 18 to power source 15. The power source is connected to one or more other electrodes (not shown) and preferably to one or more other combination production electrode-drain hole wells. The power source is capable of supplying either DC, pulsating DC, or single phase, 3-phase or other poly-phase, uniform or eccentric AC power at voltages up to several thousand volts and currents up to 1200 amperes and higher. Alternating current is preferred.

In FIG. 1, the thickness of the formation is represented by height "H" and the drain hole wellbores extend laterally into formation 12 by distance "L". The ratio of L/H is significant to the objectives of this invention as will hereinafter be shown in connection with FIG. 2. The drain holes are cased with tubular steel pipes 19 and 20 which may be casing, tubing, drill pipe or any other form of steel tubular goods. Steel pipes 19 and 20 have cylindrical flow passages 21 and 22 respectively which fluidly communicate with flow passage 14 in production casing 13. Preferably, the parts tubular steel members 13, 19 and 20 located in the formation are perforated with perforations 23. The drain holes pipes are, therefore, in fluid communication with the formation and collect oil flowing from the formation into the pipes. The oil flows through cylindrical passages 21 and 22 into flow passage 14. Since the rate of flow into the drain holes is a significant factor in the degree of improved results achieved from the combination of this invention, it is highly desirable that drain hole pipes be a part of the production well electrode. This increases the electrode surface area while spreading the maximum points of electrical resistance heating over a wider area of the formation and heating oil at the points of highest flow resistance. Accordingly, it is preferred that the drain hole pipes be electrically connected to production casing 13. Moreover, although it it is unlikely that cyclindrical flow passages 21 and 22 will be a factor limiting the rate of oil drainage it is preferred that the diameter of these flow passage be at least as great as 0.25 of the diameter of flow passage 14.

For illustrative purposes, the vertical part of the production well extends through formation 12 and drain hole pipe 19 and 20 are shown connected to production well casing 13 in the formation, but this is not necesarily the case. It is difficult to install tubular pipe in drain holes having a radius of curvature of less than 30 feet. Even curvatures of 30 feet require special knuckle-type bendable pipe joints, for example U.S. Pat. Nos. 3,349,845 and 3,398,804. More standard types of pipes may require a radius of curvature of 300 feet or more and thickness or height "H" of the pay zone of formation 12 may be less than three hundred feet. Accordingly, the point of juncture of the drain hole pipes and production casing 13 may be in the overburden above the formation and the vertical part of the well may not extend into formation 12. In such case, the outer surface of the drain hole tubular pipes in the overburden may also be insulated to prevent loss of electrical power.

In FIG. 2, a top plan view of flow oil production wells with different numbers of drain hole configurations is shown. Well 23 has one laterally extending drain hole 24. Well 25 has two lateral drain holes 26 and 27 at angles of 180° to each other. Wells 23 and 25 are electrically connected via conductors 28 and 29 to power source 30. Well 31 has three lateral drain holes, 32, 33 and 34 at angles of 120° to each other. Well 35 has four lateral drain holes, 36, 37, 38 and 39 at angles of 90° to each other. Wells 31 and 35 are electricaly connected via conductors 40 and 41 to power source 42. These four configurations illustrate the it is desirable in a given well to space the drain holes as far apart as practical. As voltage is maintained across wells 23 and 25 and wells 31 and 35 current flows between the wells and heats the viscous oil in the formation thereby reducing its viscosity. For example, a dead viscous oil sample had a viscosity of 15,000 centipose at 85° F., 1,000 centipose at 135° F. and 170 centipose at 185° F. The advantages of the combination of production well electrodes with drain holes can be seen in Table 1 which is based on electrolytic models scaled roughly to the UGNU reservoir in Alaska. The four lateral drain hole configurations of FIG. 2 were used assuming that the vertical portion of the well extends through the formation. In the model, the drain holes were centered mid depth of a reservoir with "H" equal to 150 feet. Three drain hole lengths of feet, 300 feet and 450 feet were used. It was assumed that the drain holes were perforated, had an effective radius of 0.5 foot and joined production well casing 13. Steady state flow from an outer radius of 1000 feet was used. The results shown in Table 1 were obtained.

TABLE 1

| L/H | PRODUCTIVITY RATIO Well with Drainholes / Vertical Well: 1 lateral | 2 laterals | 3 laterals | 4 laterals |
|---|---|---|---|---|
| | A. Drain Holes Without Electricity | | | |
| 3 | 2.43 | 3.50 | 4.27 | 4.60 |
| 2 | 1.98 | 2.74 | 3.34 | 3.48 |
| 1 | 1.50 | 1.93 | 2.27 | 2.52 |
| 0 | 1 | 1 | 1 | 1 |
| | B. Drain Holes With Electricity | | | |
| 3 | 7-12 | 10-17 | 13-21 | 14-23 |
| 2 | 6-10 | 8-14 | 10-16 | 10-17 |
| 1 | 4-7 | 6-10 | 7-11 | 8-13 |
| 0 | 3-5 | 3-5 | 3-5 | 3-5 |

In operation, the producing area is prepared for the process of this invention. Preparation of the producing area will include selection of the desired number of combined electrode-lateral drain hole wells to be completed in accordance with the principles set forth above and the well patterns for producing and injection wells. This selection will partially depend on the type and number of phases of the electrical power to be applied. For example, direct current may be used in some parts of the formation while alternating current is applied in other parts. By way of further example, a six phase configuration, with or without neutral voltage may be employed in conjunction with a hexagonal well pattern. If desired, the producing area may be preheated with electricity, steam or other form of heat. Sometimes there may be insufficient pressure differential between the formation and the producing wellbore. External energy, for example, water or flue gas injection, may be added to pressurize the formation.

When the producing area is prepared and at least one combined electrode-lateral drain hole well is completed in the formation, voltage and current will be generated in a conventional manner. Electrical voltages varying from a few hundred volts to 1000 or more will be applied to the electrode production and injection wells and currents from few hundred to 1000 or more amperes will be flowed between the electrodes. Most of the power will flow through the formation between the electrodes. Since there will be a high current density adjacent the combined electrode-lateral drain hole producing well or wells, the temperature will tend to increase more rapidly near the producing wells thereby stimulating increased oil production. Simultaneously, hot water or steam may be injected into the formation at a pressure suitable to confine the electrically heated oil and maintain sufficient pressure to force oil toward the producing wells.

From the foregoing, it can be seen that this disclosure achieves the purposes previously mentioned and that this invention is suitable for use in many of the prior art systems. Although this invention has been described with a certain degree of particularity, it is understood that the present disclosure has been made only by way of example and that numerous changes in the details of construction and the combination and arrangement of parts may be resorted to without departing from the spirit and the scope of this invention.

I claim:

1. A method of producing oil from a subsurface formation containing viscous oil comprising drilling and completing a first well in said formation in a manner such that said well has an essentially vertical portion and at least one drain hole extending laterally from the longitudinal axis of said portion of said first well, at least a part of said laterally extending drain hole traversing a part of said formation, said vertical portion of said first well being in communication with the surface of the earth, said drain hole being in fluid communication with said vertical portion of said first well, said first well being completed in said formation in a manner such that the effective radius of said well is substantially greater than the effective radius of a vertical well completed in said formation, applying electric current through said first well into said formation, and producing oil through said drain hole and said first well.

2. The method of claim 1 wherein said drain hole is cased with tubular steel pipe.

3. The method of claim 2 wherein the diameter of the cylindrical passage through said tubular pipe in said drain hole is at least as great as 0.25 times the diameter of the flow passage through said vertical portion of said first well.

4. The method of claim 1 wherein said vertical portion of said first well extends into and traverses at least a part of said formation.

5. The method of claim 4 wherein said drain hole is cased with tubular steel pipe.

6. The method of claim 5 wherein the diameter of the cylindrical passage through said tubular pipe in said drain hole is at least as great as 0.25 times the diameter of the flow passage through said vertical portion of said first well.

7. The method of claim 1 wherein said first well is completed in a manner such that at least two drain holes extend laterally from the longitudinal axis of said vertical portion of said first well at least a part of each of said laterally extending drain holes traversing a part of said formation, each of said drain holes being in fluid communication with said vertical part of said first well.

8. The method of claim 7 wherein said drain holes are cased with tubular steel pipes.

9. The method of claim 8 wherein the diameter of the cylindrical passages through said tubular pipes in said drain holes are at least as great as 0.25 times the diameter of the flow passage through said vertical portion of said first well.

10. The method of claim 7 wherein said vertical portion of said first well extends into and traverses at least a part of said formation.

11. The method of claim 10 wherein said drain holes are cased with tubular steel pipes.

12. The method of claim 11 wherein the diameter of the cylindrical passages through said tubular pipes in said drain holes are at least as great as 0.25 times the diameter of the flow passage through said vertical portion of said first well.

13. The method of claim 1 wherein a second well is drilled and completed in said formation in a manner such that said second well has an essentially vertical portion and at least one drain hole extending laterally from the longitudinal axis of said portion of said second well, at least a part of said laterally extending drain hole traversing a part of said formation, said vertical portion of said second well being in communication with the surface of the earth, said drain hole being in fluid communication with said vertical portion of said second well, said second well being completed in said formation in a manner such that the effective radius of said second well is substantially greater than the effective radius of a vertical well completed in said formation, applying electric current through said second well into said formation, and producing oil through said drain hole and said second well.

14. The method of claim 13 wherein said drain hole extending from said second well is cased with tubular steel pipe.

15. The method of claim 14 wherein the diameter of the cylindrical passage through said tubular pipe in said drain hole extending from from said second well is at least as great as 0.25 times the diameter of the flow passage through the vertical portion of said second well.

16. The method of claim 13 wherein said second well is completed in a manner such that at least two drain holes extend laterally from the longitudinal axis of said vertical portion of said second well, at least a part of each of said laterally extending drain holes traversing a part of said formation, each of said drain holes extending from said second well being in fluid communication with said vertical part of said second well.

17. The method of claim 16 wherein drain holes extending from said second well are cased with tubular steel pipe.

18. The method of claim 17 wherein the diameter of the cylindrical passage through said tubular pipe in said drain hole is at least as great as 0.25 times the diameter of said tubular pipe of the portion of said tubular pipe of said first well extending into said formation.

19. The method of claim 13 wherein said first and said second wells are completed in a manner such that at least two drain holes extend laterally from the longitudinal axis of said vertical portions of said first and second wells, at least a part of each of said laterally extending drain holes traversing a part of said formation, each of said drain holes extending from said first well being in fluid communication with said vertical part of said first well, and each of said drain extending from said second well being in fluid communication with said vertical part of said second well.

20. The method of claim 19 wherein said drain holes extending from said wells are cased with tubular steel pipe.

21. The method of claim 20 wherein the diameter of cyclindrical passages through said tubular pipes in said drain holes in said wells are at least as great as 0.25 times the diameter of the flow passages in the vertical portions of said wells.

22. A combination electrode and producing well for passing current into a subsurface viscous oil bearing formation and producing oil from said formation comprising a wellbore extending essentially vertically from the surface into the earth, said vertical borehole being cased with tubular metallic pipe, at least one drain hole extending laterally from the vertical longitudinal axis of said vertical borehole into and traversing a part of said viscous oil bearing formation, said drain hole being cased with tubular steel pipe, said tubular steel pipe in said drain hole being electrically connected to an electrical power source near the surface of the earth, said tubular steel pipe being in fluid communication with said tubular metallic pipe in said vertical wellbore and being in fluid communication with said formation, the length of said well in said viscous oil bearing formation being substantially greater than the thickness of said viscous oil bearing formation, and the lower portion of said wellbore pipe being electrically connected to an electrical power source.

23. The combination electrode and producing well of claim 22 wherein the diameter of the cyclindrical passage in said tubular steel pipe in said drain hole is at least as great as 0.25 times the diameter of the cylindrical passage in said tubular metallic pipe in said vertical wellbore at the point where said drain hole is in fluid communication with said tubular metallic pipe.

24. The combination electrode and producing well of claim 23 wherein said essentially vertically extending wellbore extends into said viscous oil bearing formation.

25. The combination electrode and producing well of claim 22 wherein at least two drain holes extend laterally from the longitudinal axis of said vertical wellbore into and traversing a part of said viscous oil bearing formation, said drain holes being cased with tublar steel pipe, said tubular steel pipes in said drain holes being electrically connected to an electrical power source near the surface of the earth, and being in fluid communication with said tubular metallic pipe in said vertical wellbore and being in fluid communicaiton with said formation.

26. The combination electrode and producing well of claim 25 wherein the diameters of the cyclindrical passages in said tubular steel pipes in said drain holes are at least 0.25 times the diameter of the cylindrical passage in said tubular metallic pipe in said vertical wellbore at the points where said drain holes are in fluid communication with tubular metallic pipe.

* * * * *